US011019978B2

(12) United States Patent
Ting

(10) Patent No.: US 11,019,978 B2
(45) Date of Patent: Jun. 1, 2021

(54) SPIN TYPE MOP CLEANING BUCKET SUITABLE FOR CLEANING FOLDABLE FLAT MOP

(71) Applicant: Ming-Che Ting, Taoyuan (TW)

(72) Inventor: Ming-Che Ting, Taoyuan (TW)

( * ) Notice: Subject to any disclaimer, the term of this patent is extended or adjusted under 35 U.S.C. 154(b) by 90 days.

(21) Appl. No.: 16/505,367

(22) Filed: Jul. 8, 2019

(65) Prior Publication Data

US 2020/0008643 A1 Jan. 9, 2020

(30) Foreign Application Priority Data

Jul. 9, 2018 (TW) ..... 107123672

(51) Int. Cl.
*A47L 13/58* (2006.01)
*A47L 13/258* (2006.01)

(52) U.S. Cl.
CPC ..... *A47L 13/58* (2013.01); *A47L 13/258* (2013.01)

(58) Field of Classification Search
CPC ..... A47L 13/58
USPC ..... 15/260, 263
See application file for complete search history.

(56) References Cited

U.S. PATENT DOCUMENTS 3,299,458 A * 1/1967 Royalty ..... A47L 13/58 15/1
5,361,448 A * 11/1994 Chao ..... A47L 13/58 15/263
8,407,849 B2 * 4/2013 Chen ..... A47L 13/58 15/260
9,622,639 B2 * 4/2017 Zhu ..... A47L 13/58
2011/0225762 A1 * 9/2011 Tsai ..... A47L 13/58 15/260

FOREIGN PATENT DOCUMENTS

| | | | |
|---|---|---|---|
| CN | 207462031 U | | 6/2018 |
| TW | 201406339 A | | 2/2014 |
| TW | M501825 U | | 6/2015 |
| WO | 2014040698 | * | 3/2014 |
| WO | 2015/168060 | * | 11/2015 |

OTHER PUBLICATIONS

TW Office Action dated Mar. 28, 2019 as received in Application No. 107123672.

* cited by examiner

*Primary Examiner* — Mark Spisich
(74) *Attorney, Agent, or Firm* — Maschoff Brennan

(57) ABSTRACT

Disclosed is a spin type mop cleaning bucket that is suitable for cleaning a foldable flat mop, comprising a bucket body and a spinning device mounted on a bottom portion of the bucket body, the spinning device having a spinning element and a pair of receiving recesses, and the spinning element being spun around a longitudinal axis of the spinning element to spin on the bucket body, wherein the pair of receiving recesses is provide to receive the folded foldable flat mop such that the spinning element of the spinning device spins on the bucket body as driven by a spinning force of the foldable flat mop which is spinning.

6 Claims, 14 Drawing Sheets

SPIN TYPE MOP CLEANING BUCKET SUITABLE FOR CLEANING FOLDABLE FLAT MOP

FIELD OF THE INVENTION

The present invention relates to a mop cleaning bucket, and more particularly relates to a spin type mop cleaning bucket suitable for cleaning a foldable flat mop.

BACKGROUND OF THE INVENTION

A foldable flat mop T is a new type mop, as shown in FIG. 8, as compared with the conventional round type mop. The foldable flat mop T is with two wing boards, which are foldable and extendable with each other. A cleaning element M is installed under each wing board. Cleaning strips such as cotton strips are connected on the bottom surface of the cleaning element M. The cleaning element M is replaceable to extend the lifetime of the mop. The foldable flat mop T has the advantages of having larger cleaning area when the wing boards are extended as compared to the conventional round type mop, whilst the foldable flat mop T is with other advantages that it is easier to store when the wing boards are folded as compared with a non-foldable disc mop R, i.e., the round type mop (as shown in FIG. 10). Furthermore, the replaceable cleaning elements of the foldable flat mop T are with other merit that different sizes of the cleaning elements could be considered to be used. For example, a cleaning element M having a larger lateral width could be used to clean a larger cleaning area. On the other hand, a cleaning element M having a smaller lateral width can be used for power saving. In other words, different sizes of the cleaning elements could be considered for different requirements. As mentioned above, the storage space saving for the foldable flat mop T brings other benefits. However, there has not yet any cleaning bucket for cleaning this new type foldable flat mop, especially when how to enhance the cleaning effect of the foldable flat and be used conveniently are considered.

SUMMARY OF THE INVENTION

An objective of the present invention is to provide a spin type mop cleaning bucket suitable for cleaning a foldable flat mop that sophisticatedly uses the foldable and extendable characteristics of the wings boards of the foldable flat mop to enhance the cleaning effect of the foldable flat and to use conveniently. In detail, the spin type mop cleaning bucket of the present invention allows the foldable flat mop to move among several different positions including an attaching position, a cleaning position, a dehydrating position and a detaching position so as to respectively perform operations of attaching, cleaning, dehydrating and separating the foldable flat mop.

In order to overcome the technical problems in prior art, the present invention provides a spin type mop cleaning bucket that is suitable for cleaning a foldable flat mop, comprising: a bucket body having a bottom portion; and a spinning device mounted on the bottom portion of the bucket body, the spinning device having a spinning element and a pair of receiving recesses, and the spinning element being spun around a longitudinal axis of the spinning element to spin on the bucket body, wherein the pair of receiving recesses are provided to receive the folded foldable flat mop such that the spinning element of the spinning device spins on the bucket body as driven by a spinning force of the foldable flat mop which is spinning.

In the spin type mop cleaning bucket according to one embodiment of the present invention, the spinning device is provided with a pair of barrier blocks, each barrier block is annularly disposed on an upper surface of the spinning device, the pair of barrier blocks are spaced apart, by the pair of receiving recesses, from each other.

In one embodiment of the present invention, it provides the spin type mop cleaning bucket further comprising an annular rim element, the annular rim element being provided at an upper edge of the bucket body, the annular rim element having a through hole such that the foldable flat mop is folded from an unfolded state while passing through the through hole of the annular rim element from outside of the bucket body.

In the spin type mop cleaning bucket according to one embodiment of the present invention, the spinning device is provided with a receiving base, the receiving base is provided to support the folded foldable flat mop, the receiving base has a sleeve hole through which the pair of barrier blocks sleeve in such a manner that the receiving base is moved relative to the pair of barrier blocks with multiple halt positions.

In the spin type mop cleaning bucket according to one embodiment of the present invention, the side surface of the receiving base is provided with a position shifting groove, an inner side surface of each barrier block is provided with a positioning groove, a roller is kept within the position shifting groove and the positioning groove in such a manner that the receiving base and the barrier block are in longitudinal movement in relation to the position shifting groove, the positioning groove has a plurality of sequential extending groove portions including, in sequence, a longitudinal groove portion, a guiding groove portion, a parking groove portion and a restoring groove portion, in which the restoring groove portion extends back to the longitudinal groove portion, wherein the roller moves within the position shifting groove and the positioning groove in such a manner that the receiving base moves in a longitudinal direction in relation to the positioning groove and halts in a first halt position and a second halt position, (1) the first halt position: the foldable flat mop pushes the receiving base to move downward, the downward movement of the receiving base allows the roller to move downward through the longitudinal groove portion to a bottom side of the longitudinal groove portion until the receiving base arrives at a bottom of the spinning device such that the receiving base is in the first halt position, (2) the second halt position: the foldable flat mop pulls the receiving base, from the first halt position, to move upward, the upward movement of the receiving base allows the roller to move upward from the bottom side of the longitudinal groove portion and the guiding groove portion until the roller stays in the parking groove portion such that the receiving base is in the second halt position when the roller stays in the parking groove portion, and (3) from the second halt position back to the first halt position: during the receiving base is in the second halt position, when the foldable flat mop pushes the receiving base to move downward, the downward movement of the receiving base allows the roller to move through the restoring groove portion, move downward through the longitudinal groove portion and move to the bottom side of the longitudinal groove portion until the receiving base arrives at a bottom of the spinning device such that the receiving base is back to the first halt position.

In the spin type mop cleaning bucket according to one embodiment of the present invention, a plurality of the spinning devices are provided, the plurality of the spinning devices are mounted on the bottom portion of the bucket body, the height of the plurality of the spinning devices are different from each other.

In the spin type mop cleaning bucket according to one embodiment of the present invention, a partition element is provided between the plurality of spinning devices.

In the spin type mop cleaning bucket according to one embodiment of the present invention, the foldable flat mop is a simultaneous foldable type flat mop whose two sides are simultaneous foldable, and when the foldable flat mop is pulled away from the pair of receiving recesses, a centrifugal force generated by a spinning of the foldable flat mop enables the foldable flat mop to be unfolded.

With the technical means adopted by the present invention, the spin type mop cleaning bucket of the present invention can perform the cleaning and dehydrating operations by allowing the foldable flat mop to sequentially move between different positions including a cleaning position and a dehydrating position by which cotton cloth under the cleaning elements of the foldable flat mop T could be cleaned more effectively in a very convenient way. Moreover, since the spin type mop cleaning bucket is designed for the folded foldable flat mop, therefore the size including width and length of the mop cleaning bucket can be effectively and greatly reduced such that the spin type cleaning bucket is with other merits such as carrying cost reduction and the space saving.

DETAILED DESCRIPTION OF THE PREFERRED EMBODIMENTS

The preferred embodiments of the present invention are described in detail below with reference to FIG. 1 to FIG. 9. The description is used for explaining the embodiments of the present invention only, but not for limiting the scope of the claims.

Figure 9:
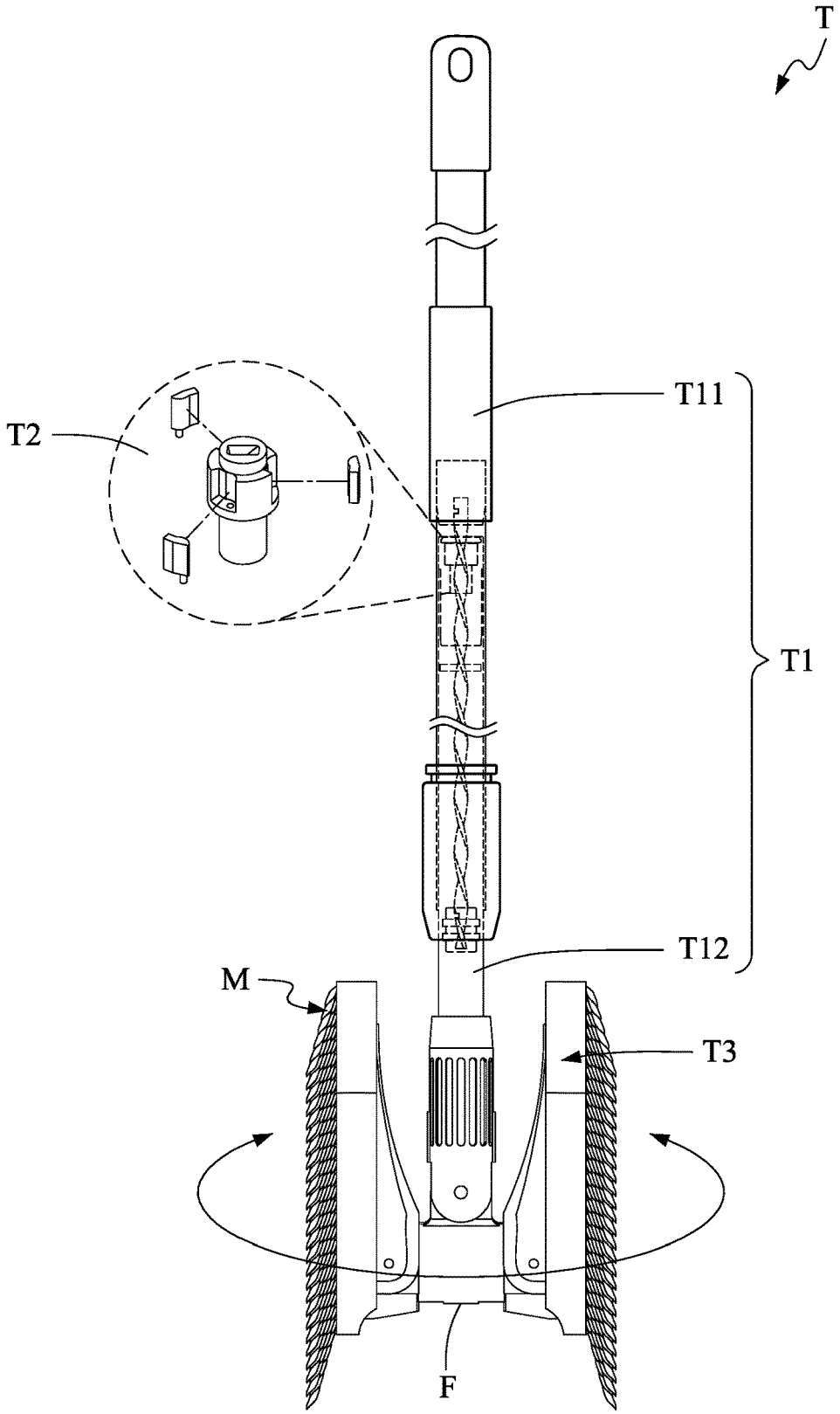
FIG. 9 is a schematic drawing illustrating the folded foldable flat mop which is rotating.
Figure 10:
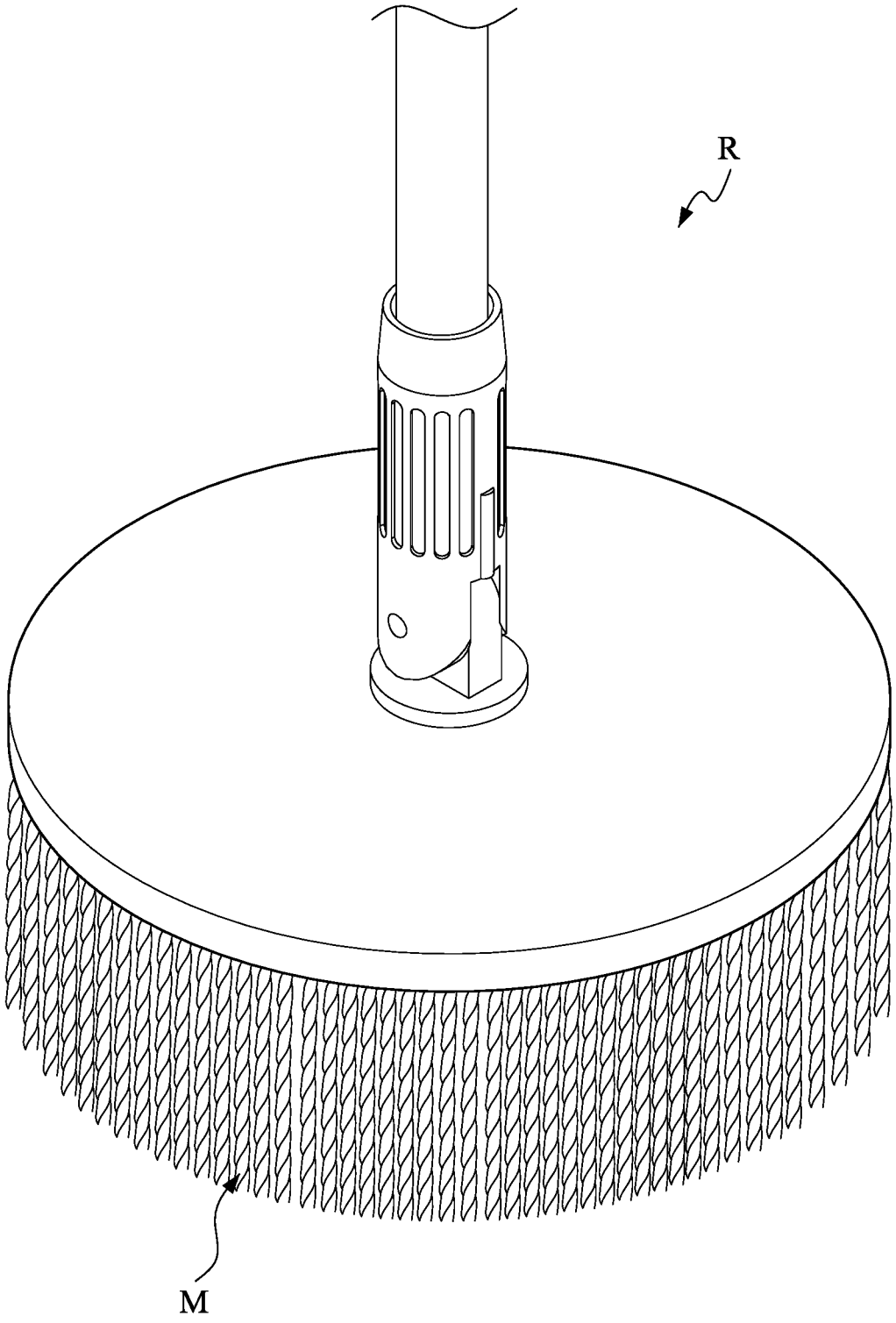
FIG. 10 is a schematic drawing illustrating a disc mop.

The present invention is related to a foldable flat mop T, preferably a simultaneous foldable type flat mop, which could be folded and unfolded simultaneous. As shown in FIG. 9, the foldable flat mop T can be rotated as follows. The handle T1 of the foldable flat mop T comprises a first handle member T11 in an upper position and a second handle member T12 in a lower position. A rotation member T2 is disposed around a connection position between the first handle member T11 and the second handle member T12 such that when the rotation member T2 receives a pressing down force from the first handle member T11, the second handle member T12 is driven to rotation. Accordingly, a mop head T3 will then rotate in relation to the first handle member T11 because the mop head T3 is attached with the second handle member T12.

Figure 1:
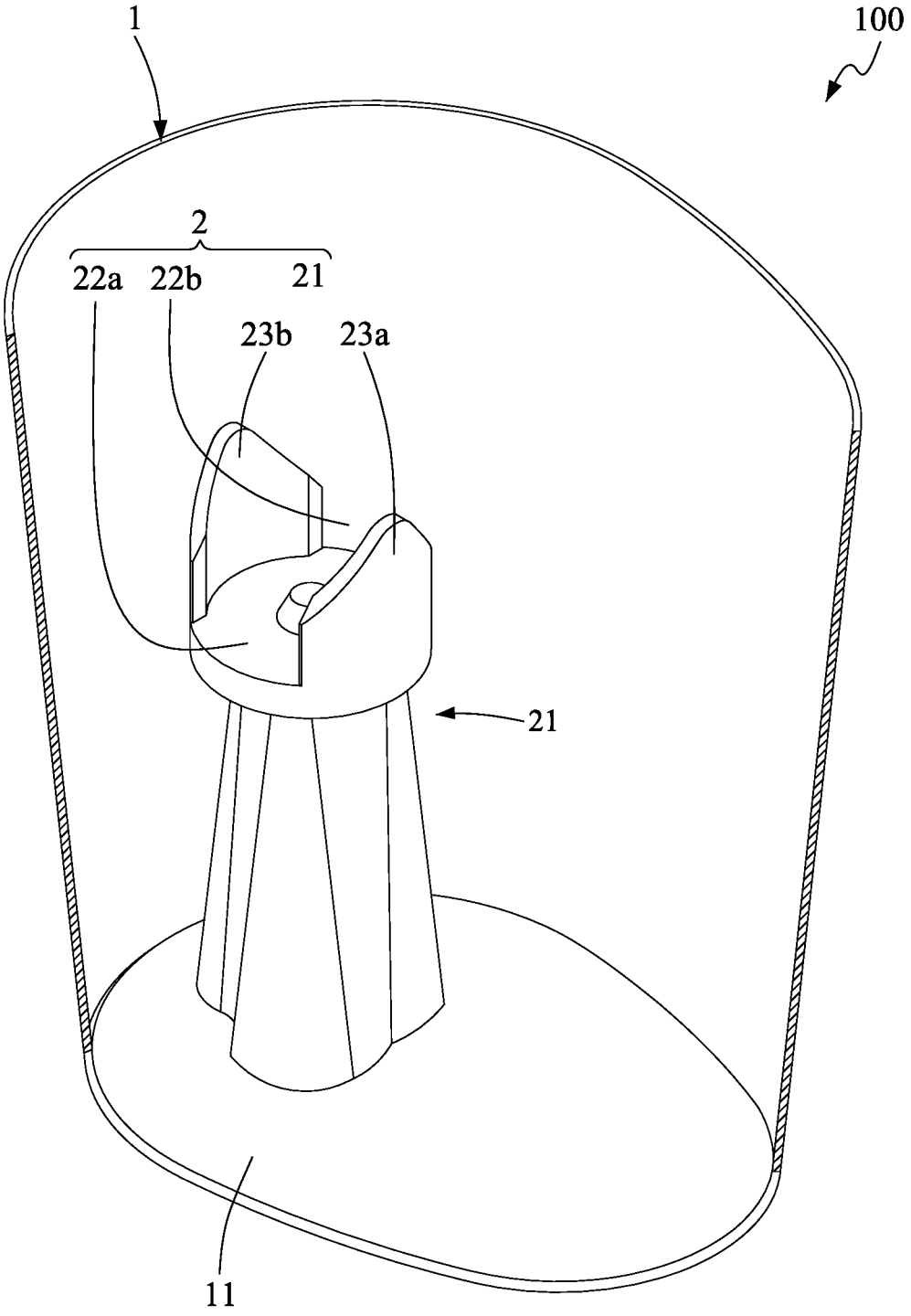
FIG. 1 is a schematic drawing illustrating a spin type mop cleaning bucket according to one embodiment of the present invention.
Figure 2:
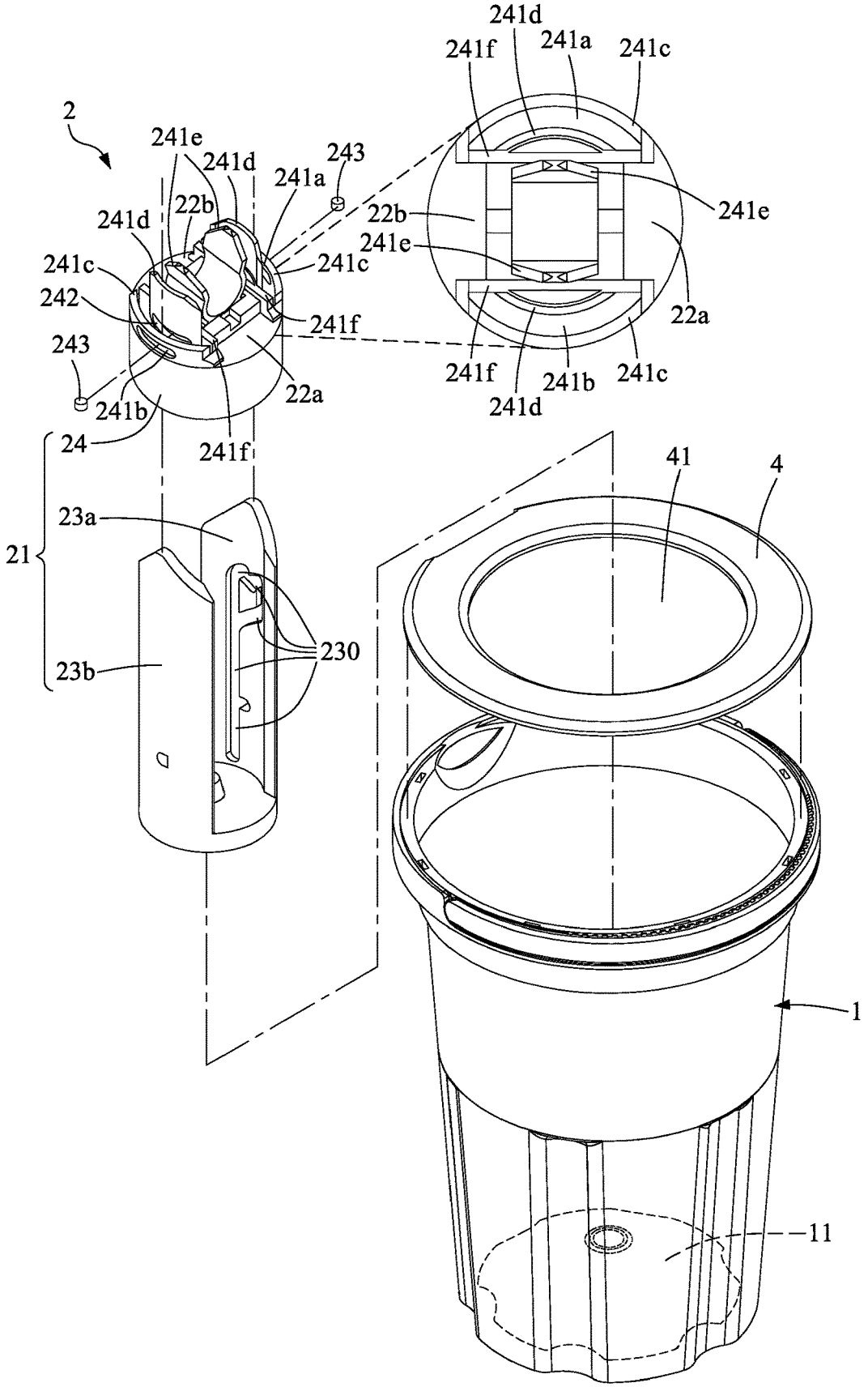
FIG. 2 is a schematic drawing illustrating a spin type mop cleaning bucket according to one embodiment of the present invention.

As shown in FIG. 1, according to one embodiment of the present invention, a spin type mop cleaning bucket 100 of the present application that is suitable for cleaning a foldable flat mop includes a bucket body 1 and a spinning device 2. The bucket body 1 has a bottom portion 11. The spinning device 2 is mounted on the bottom portion 11 of the bucket body 1 via a bearing (not shown). The bearing could be disposed within the bucket body 1 to attach to a shaft of the spinning device 2, but the present invention is not limited to this. The bearing could be disposed on a bottom surface of the spinning device 2 to attach to a shaft of the bucket body 1. Furthermore, as shown in FIG. 2, the spin type mop cleaning bucket 100*a* in this embodiment further includes an annular rim element 4. The annular rim element 4 is provided on an upper edge of the bucket body 1 to prevent water from slopping out of the bucket body 1, especially when the foldable flat mop T is being subjected to a water cleaning and is being subjected to dehydration. Since the annular rim element 4 is provided with a through hole 41, the foldable flat mop T is folded from an unfolded state while passing through the through hole 41 of the annular rim element 4 from outside of the bucket body 1.

The spinning device 2 has a spinning element 21 and a pair of receiving recesses 22*a* and 22*b*. The spinning element 21 spins on the bucket body 1 in a longitudinal axis of the spinning element 21. The pair of receiving recesses 22*a* and 22*b* are provided to receive the folded foldable flat mop T such that, when the foldable flat mop T is spinning, the foldable flat mop T applies a spinning force on the spinning element 21 of the spinning device 2 spins to spin the spinning element 21 on the bucket body. In addition, when the foldable flat mop T is pulled away from the pair of receiving recesses 22*a* and 22*b*, a centrifugal force generated by a spinning of the foldable flat mop T enables the foldable flat mop T to be unfolded.

Figure 3A:
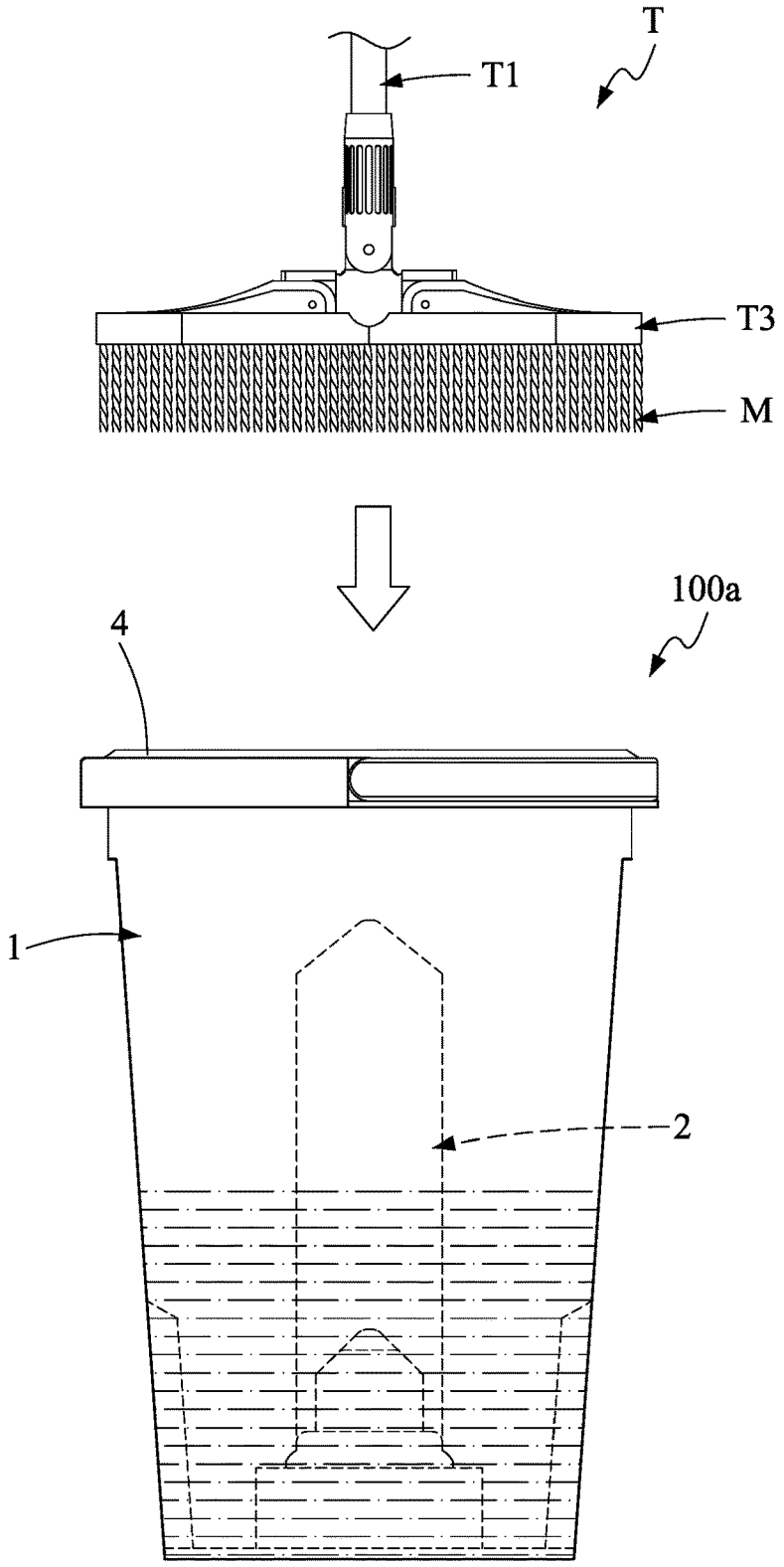
FIG. 3*a* is a schematic drawing illustrating the spin type mop cleaning bucket according to the embodiment of the present invention when a foldable flat mop is being received.
Figure 3B:
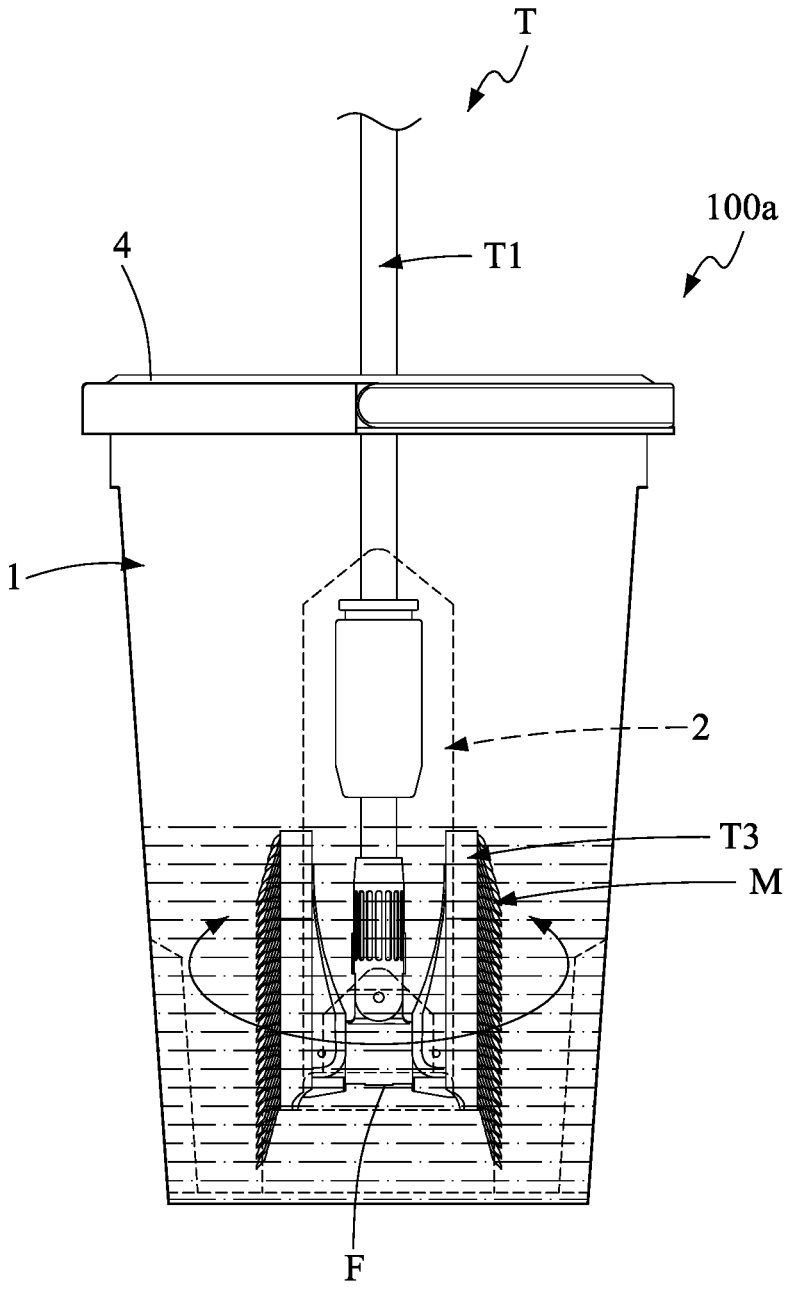
FIG. 3*b* is a schematic drawing illustrating the spin type mop cleaning bucket according to the embodiment of the present invention when the foldable flat mop is being subjected to a water cleaning.
Figure 3C:
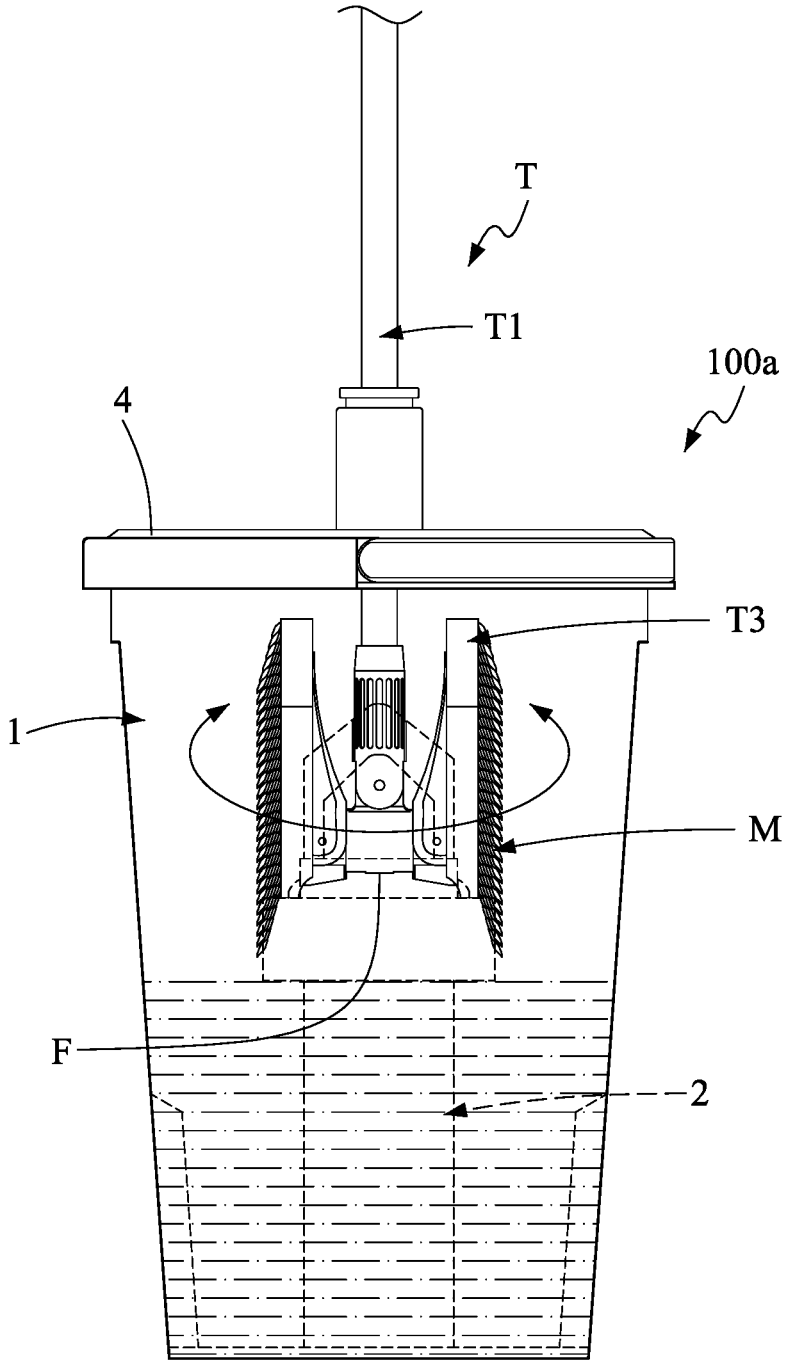
FIG. 3*c* is a schematic drawing illustrating the spin type mop cleaning bucket according to the embodiment of the present invention when the foldable flat mop is subjected to an out-of-water dehydration.

The spin type mop cleaning bucket 100*a* in the present invention is provided to receive the folded foldable flat mop T (as shown in FIG. 3*a*) such that the foldable flat mop T can be subjected to a water cleaning (as shown in FIG. 3*b*), an out-of-water dehydration (as shown in FIG. 3*c*) and a pulled-away operation.

Figure 4:
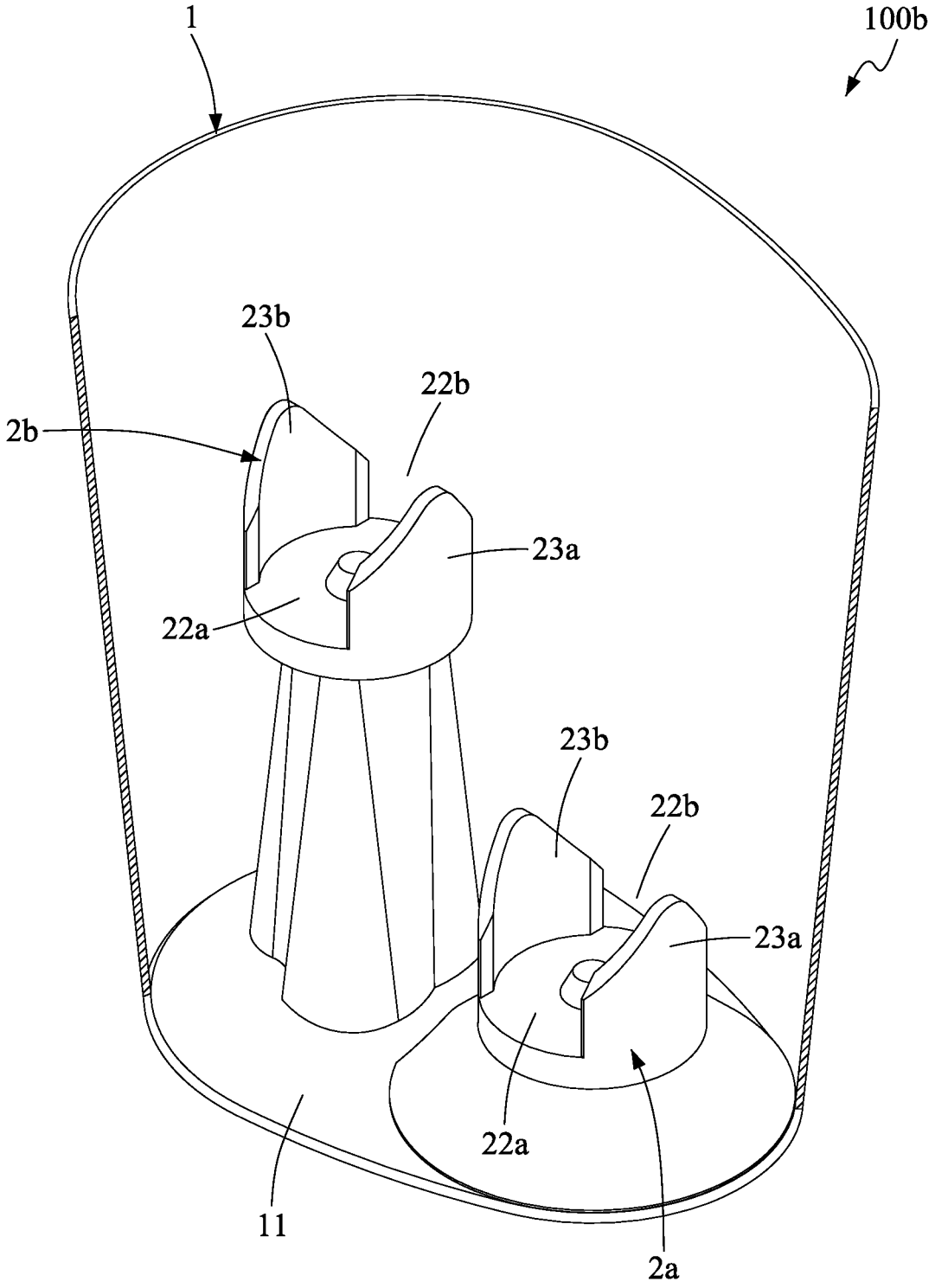
FIG. 4 is a schematic drawing illustrating a spin type mop cleaning bucket according to another embodiment of the present invention.

The above are operated on the bucket body 1 having one spinning device (as shown in FIG. 1, FIG. 2, FIG. 3*a*, FIG. 3*b* and FIG. 3*c*) or two spinning devices (as shown in FIG. 4). In FIG. 4, a spin type mop cleaning bucket 100*b* illustrates that the bucket body 1 is with two spinning devices, in which a height of one spinning device 2*a* (hereinafter "a first spinning device") is lower than that of the other spinning device 2*b* (hereinafter "a second spinning device"). The first spinning device 2*a*, which is with a lower height, is provided to receive the folded foldable flat mop T for performing water cleaning of the foldable flat mop T. The second spinning device, which is with a higher height, is provided to receive the folded foldable flat mop T and perform dehydration for the foldable flat mop T.

As shown in FIG. 1, FIG. 2, FIG. 4 and FIG. 5, the spinning device 2 is provided with a pair of barrier blocks 23*a* and 23*b*. Two barrier blocks (23*a*, 23*b*) are interval disposed with each other to annularly dispose on an upper surface of the spinning device 2. A pair of receiving recesses 22*a* and 22*b* are provided on the spinning device. Each receiving recess (22*a* or 22*b*) is disposed between the pair of barrier blocks 23*a* and 23*b*. The receiving recesses 22*a* and 22*b* are provided to receive the foldable flat mop T such that when the mop head T3 of the foldable flat mop T spins, the spinning device 2 is driven by the mop head T3 of the foldable flat mop T for performing operations of water cleaning and dehydration.

Figure 5:
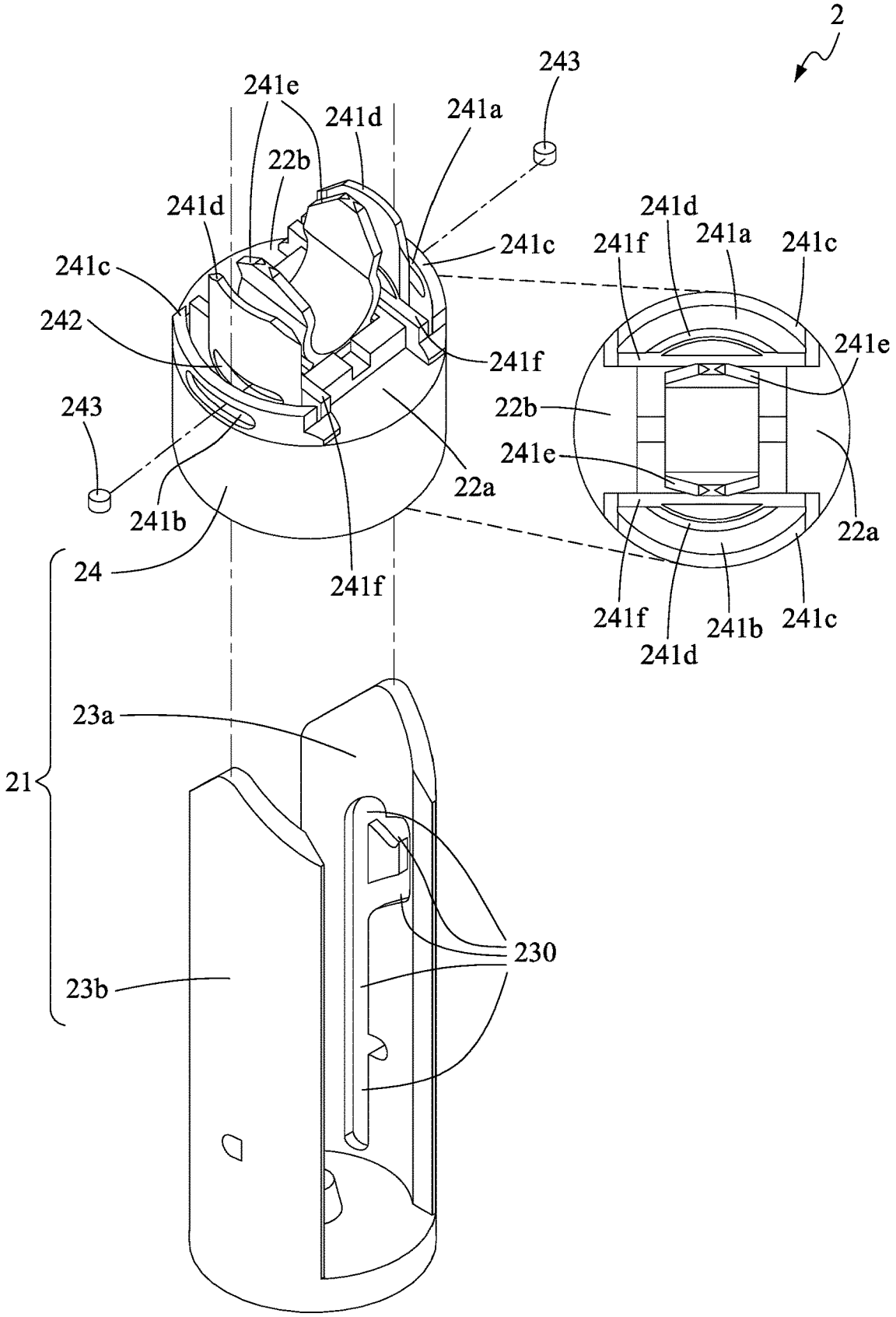
FIG. 5 is a schematic drawing illustrating the spin type mop cleaning bucket according to the embodiment of the present invention.

In another embodiment of the present application that the bucket body 1 is only provided with one single spinning device, as shown in FIG. 5, the spinning device 2 is provided with a receiving base 24. The receiving base 24 has a pair of sleeve holes 241*a* and 241*b* through which the pair of barrier blocks 23*a* and 23*b* sleeve, such that the barrier blocks 23*a* and 23*b* sleeve through sleeve holes 241*a* and 241*b* to enable the receiving base 24 to dispose between the pair of barrier blocks 23*a* and 23*b*. Each one of the sleeve hole 241*a* and 241*b* is surround by a curve fence 241*c*, a wall 241*d* and a block 241*f*. A supporter 241*e* of the receiving base 24 is provided to support the mop head T3. The receiving base 24 moves upward and downward relative to the pair of barrier blocks 23*a* and 23*b* with two halt positions as follows.

Figure 6A:
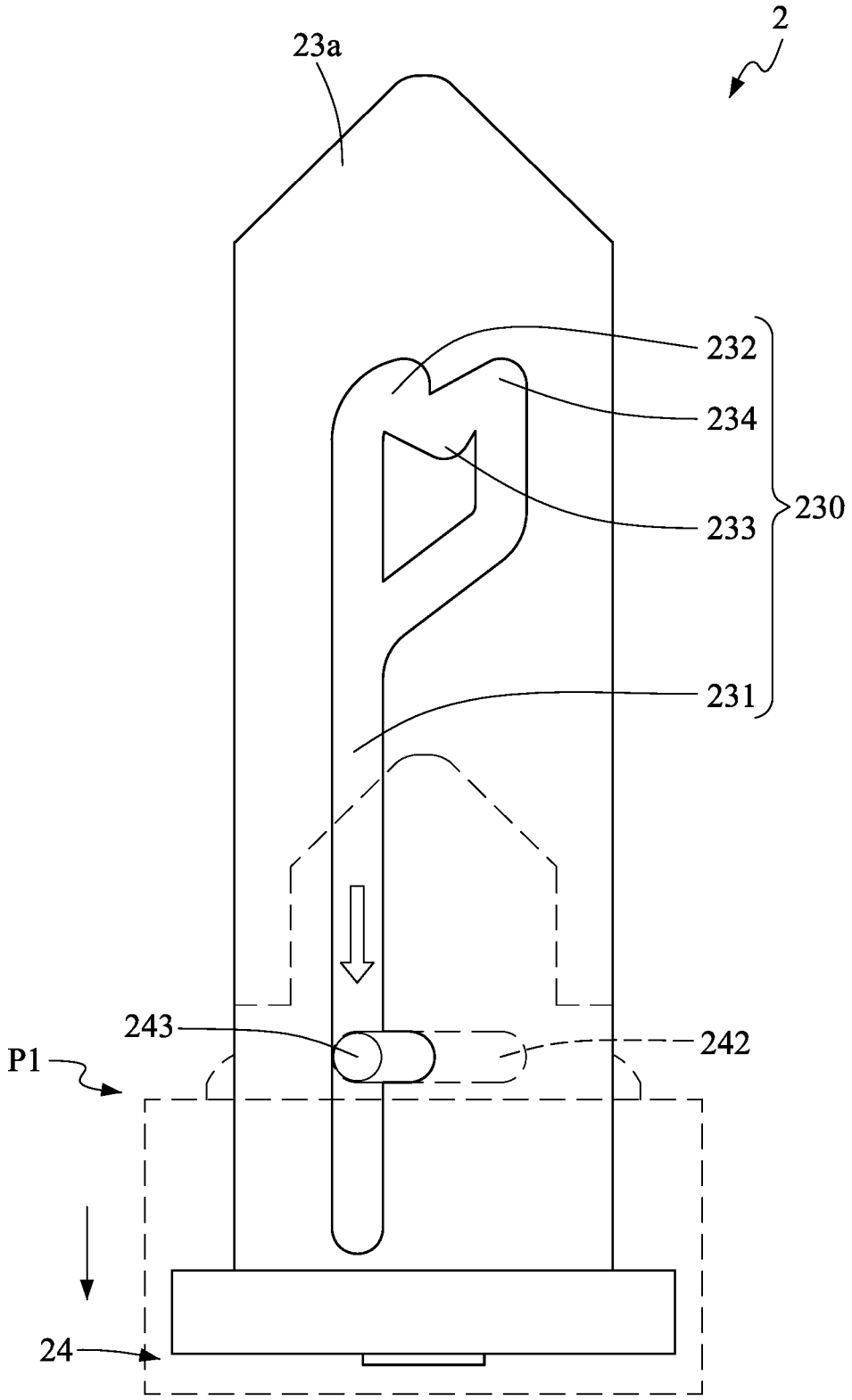
FIG. 6*a* is a schematic drawing illustrating the spin type mop cleaning bucket according to the embodiment of the present invention when being in a first halt position.

As shown in FIG. 5, FIG. 6*a*, FIG. 6*b* and FIG. 6*c*, one side surface and/or each one of two opposite side surfaces of the receiving base 24 is provided with a position shifting groove 242. An inner side surface of each barrier block (23*a*, 23*b*) is provided with a positioning groove 230. A roller 243 is positioned in a channel formed between the position shifting groove 242 and the positioning groove 230. The receiving base 24 moves upward and downward in relation to the barrier block (23*a*, 23*b*). The positioning groove 230 has a plurality of sequential extending groove portions including, in sequence, a longitudinal groove portion 231, a guiding groove portion 232, a parking groove portion 233 and a restoring groove portion 234. The restoring groove portion 234 extends back to the longitudinal groove portion 231. The roller 234 moves within the position shifting groove 242 and the positioning groove 230 in such a manner that the receiving base 24 moves in a longitudinal direction in relation to the positioning groove 230. Initially, the roller 243 is in any longitudinal positions of the longitudinal groove portion 231 or is in any positions in a path from the restoring groove portion 234 to go downward and to tilt downward to the left as shown in FIG. 6*a*. The cleaning element M of the foldable flat mop T is moved from outside of the bucket body 1 toward the bottom of the bucket body 1. The cleaning element M is folded after the cleaning element M passes through the annular rim element 4, as shown in FIG. 3*b*. With the approaching of the cleaning element M to the receiving base 24, the roller 243 moves from any longitudinal positions of the longitudinal groove portion 231 to go downward or the roller moves from any positions in a path from the restoring groove portion 234 to go downward and to tilt downward to the left and to go downward in the longitudinal groove portion 231 as shown in FIG. 6*a*. The above movement goes continuously until a supporting element F is supported by the receiving base 24 and attaches with the receiving base 24. The continuous moving downward of the supporting element F will enable the receiving base 24 to touches the bottom of the bucket body 1. Accordingly, the receiving base 24 now is in the first halt position P1, as shown in FIG. 6*a*. Then, a user will continuously push downward and pull upward the first handle member T11, resulting in the second handle member T12 to be continuously rotated together with the cleaning member M such that the water cleaning of the cleaning member M is performed.

Figure 6B:
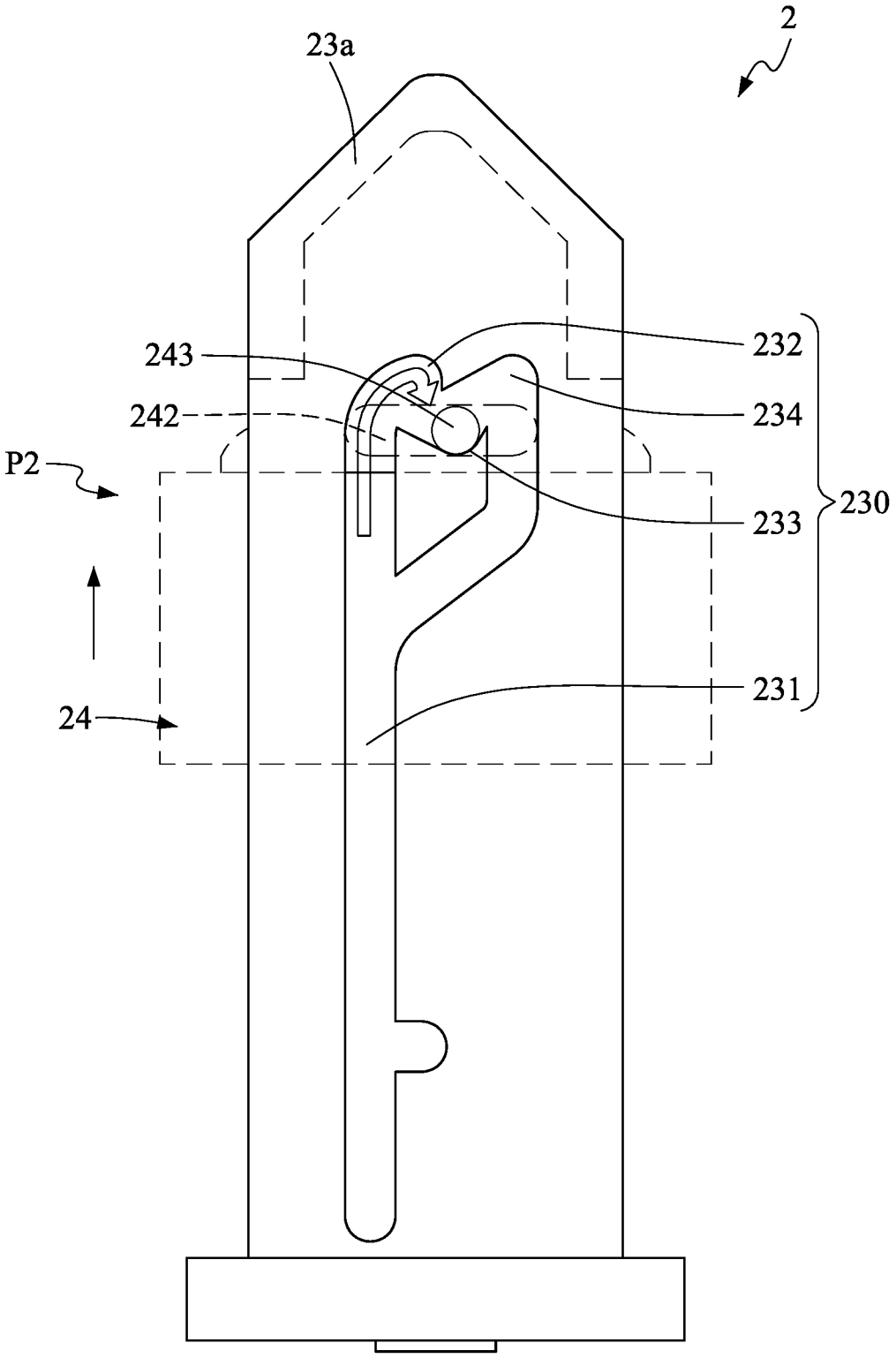
FIG. 6*b* is a schematic drawing illustrating the spin type mop cleaning bucket according to the embodiment of the present invention when being in a second halt position.

After water cleaning of the cleaning element M is finished, the cleaning element M is to be dehydrated. In order to dehydrate the cleaning element M, as shown in FIG. 6*b*, the receiving base 24 is pulled upward from the first halt position P1 to a highest position of the longitudinal groove portion 231, and then passes through the guiding groove portion 232 until the receiving base 24 reaches the parking groove portion 233. In other words, the top well of the guiding groove portion 232 depresses the roller 243 to force the roller 243 shifts right to reach the parking groove portion 233. The concave structure of the parking groove portion 233 limits the roller 243 staying in the parking groove portion 233 such that the receiving base 24 is in the second halt position P2. The parking groove portion 233, the position shifting groove 242, the guiding groove portion 232 and the restoring groove portion 234 ensure the roller 243 stays in the second halt position P2 even if a user pushes downward and pulls upward the first handle member T11 in relation to the barrier blocks (23*a*, 23*b*) as shown in FIG. 6*b*. When the receiving base 24 maintains staying in the second halt position P2, a user could dehydrate the cleaning element M, which is on the top of the receiving base 24, because a user could push downward and pull up the first handle member T11 to rotate the second handle member T12 to thus rotate the cleaning element M, as shown in FIG. 9, for dehydrate the cleaning element M.

In other words, there are two halt positions including the first halt position P1 and a second halt position P2. Regarding (1) the first halt position P1: as shown in FIG. 6*a*, the foldable flat mop T pushes the receiving base 24 to move downward, the downward movement of the receiving base 24 allows the roller 243 to move downward through the longitudinal groove portion 231 to a bottom side of the longitudinal groove portion 231 until the receiving base 24 arrives at a bottom of the spinning device 2 such that the receiving base 24 is halted in the first halt position P1.

Regarding (2) the second halt position P2: as shown in FIG. 6*b*, the foldable flat mop T pulls the receiving base 24, from the first halt position P1, to move upward, then the upward movement of the receiving base 24 allows the roller 243 to move upward from the bottom side of the longitudinal groove portion 231 to the guiding groove portion 232 until the top well of the guiding groove portion 232 depresses the roller 243 to force the roller 243 shifts right to reach the parking groove portion 233. The concave structure of the parking groove portion 233 enables the roller 243 to halt in the parking groove portion 233 such that the receiving base 24 is in the second halt position P2

Figure 6C:
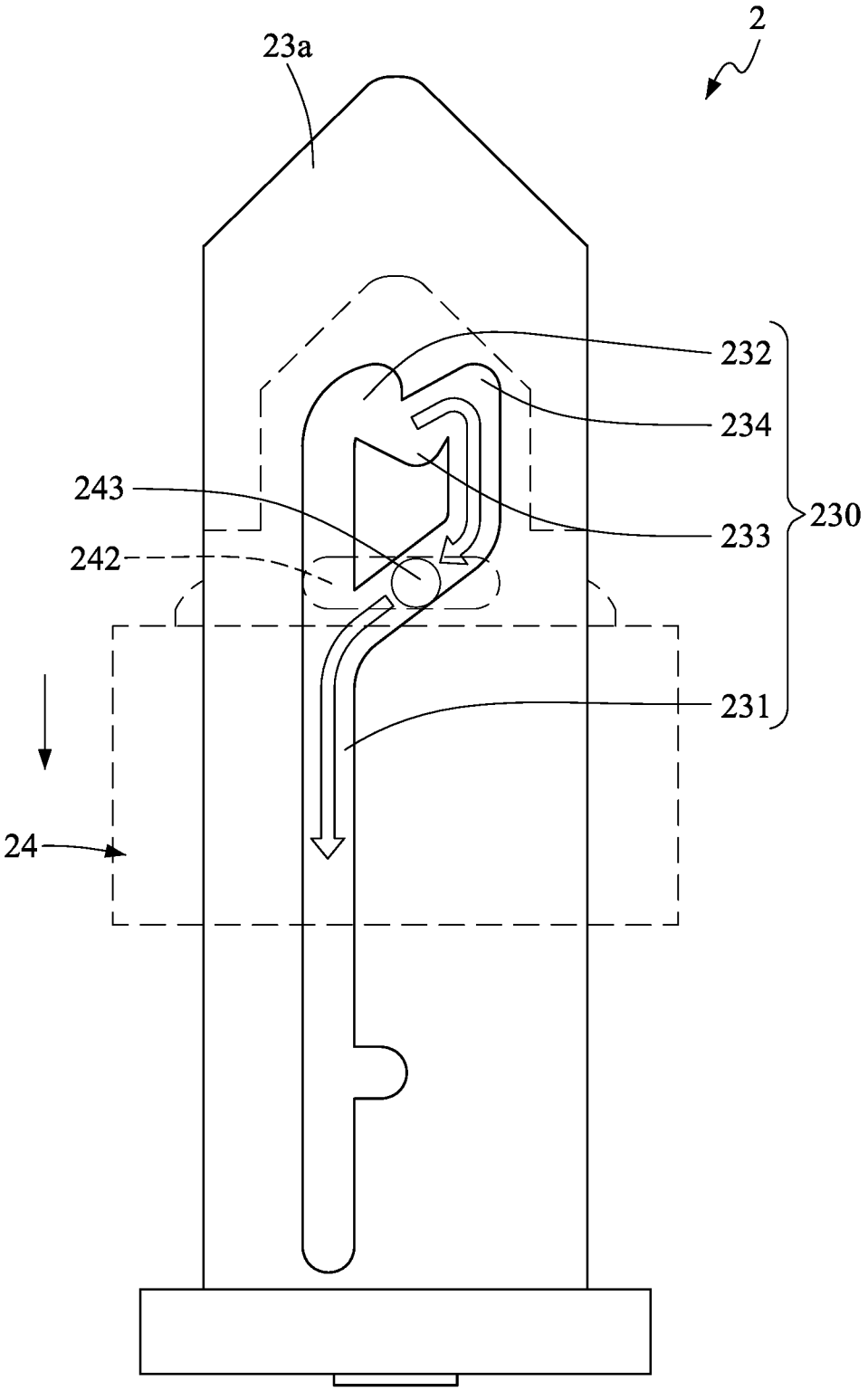
FIG. 6*c* is a schematic drawing illustrating the spin type mop cleaning bucket according to the embodiment of the present invention when being back to the first halt position.

Regarding the movement (3) from the second halt position back to the first halt position: this corresponds to an operation that the dehydrated foldable flat mop T is pulled up to depart from the receiving base 24, in which the pulling force and the centrifugal force enable the folded flat mop T to be unfolded. As shown in FIG. 6*c*, during the receiving base 24 is in the second halt position P2, when the foldable flat mop T pulls the receiving base 24 to move upward, the pulling movement of the receiving base 24 allows the roller 243 to move through the restoring groove portion 234 to move downward to move toward the longitudinal groove portion 231 and then move to the bottom side of the longitudinal groove portion 231 until the receiving base 24 reaches at a bottom of the spinning device 2 such that the receiving base 24 is back to the first halt position P1.

Figure 7:
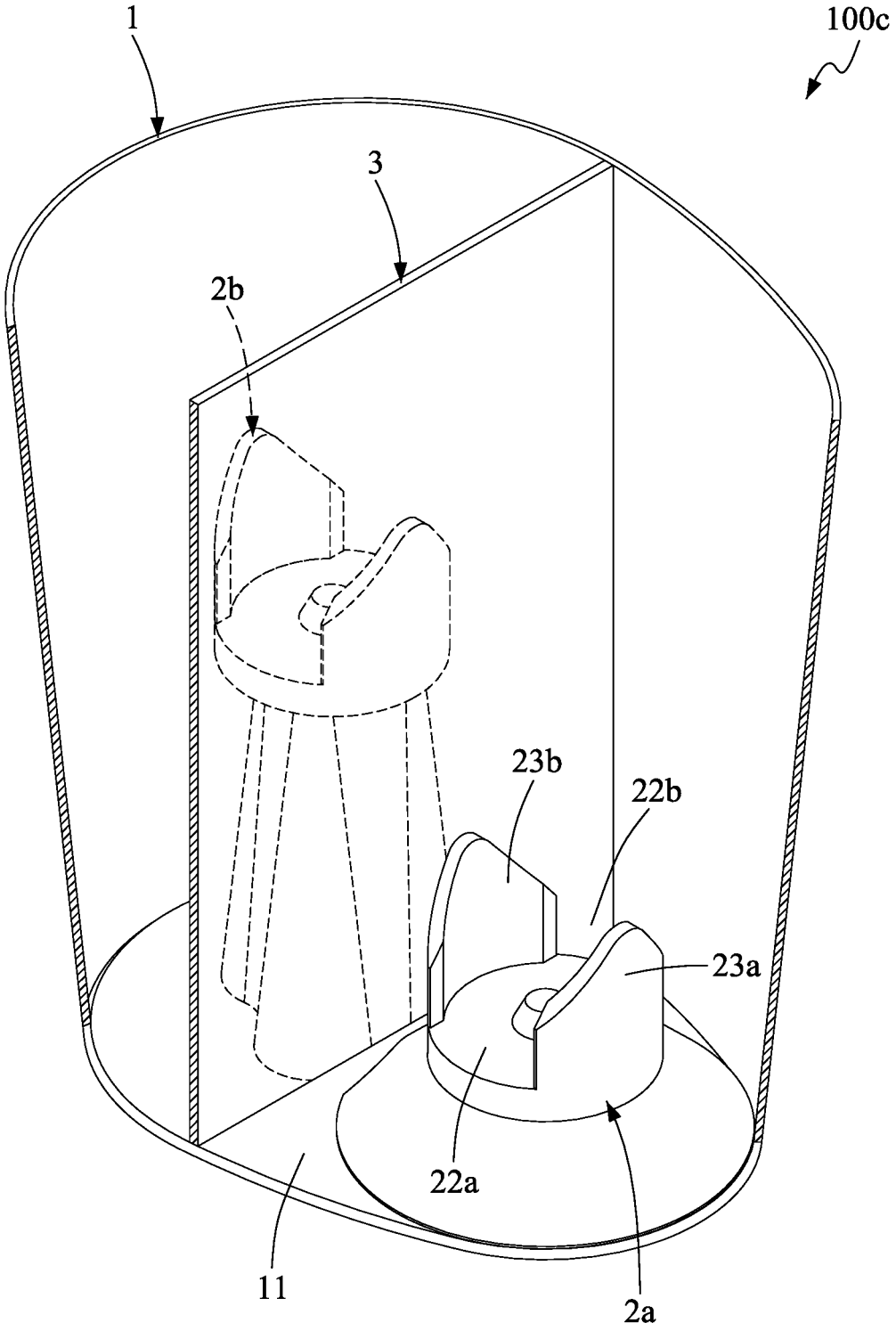
FIG. 7 is a schematic drawing illustrating a spin type mop cleaning bucket according to another embodiment of the present invention.
Figure 8:
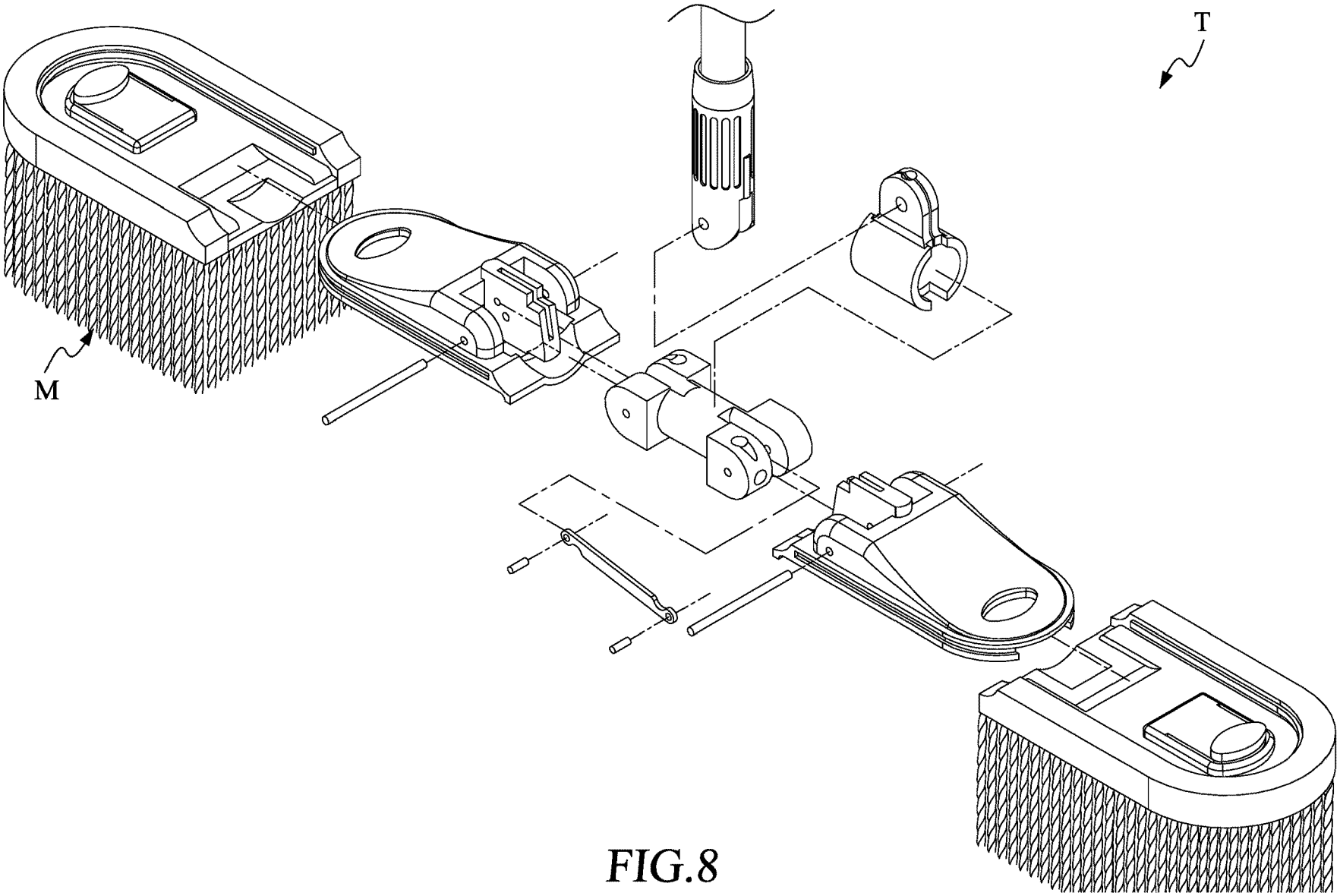
FIG. 8 is a schematic drawing illustrating a foldable flat mop.

As shown in FIG. 7, in a spin type mop cleaning bucket 100*c* according to another embodiment of the present invention, a partition element 3 is provided between the plurality of spinning devices 2*a* and 2*b* such that the water cleaning operation of the foldable flat mop T is performed in the spinning device 2*a* having a relatively less height and the dehydrating operation of the foldable flat mop T is performed in the spinning device 2*b* having a relatively great height.

With above structure provided by the present invention, the spin type mop cleaning bucket (100, 100*a*, 100*b*, 100*c*) of the present invention can perform the cleaning and dehydrating operations by allowing the foldable flat mop to sequentially move between different positions including a cleaning position and a dehydrating position by which cotton cloth of the cleaning elements could be cleaned more effectively in a very convenient way. Moreover, since the spin type mop cleaning bucket (100, 100*a*, 100*b*, 100*c*) is designed for the folded foldable flat mop, therefore the size including width and length of the mop cleaning bucket can be effectively and greatly reduced such that the spin type cleaning bucket is with other merits such as the carrying cost reduction and space saving.

The above description is only an explanation of the preferred embodiments of the present invention. One having ordinary skill in the art can make various modifications according to the above description and the claims defined below. However, those modifications shall still fall within the scope of the present invention.

What is claimed is:

1. A spin type mop cleaning bucket that is suitable for cleaning a foldable flat mop, comprising:

a bucket body having a bottom portion; and a spinning device mounted on the bottom portion of the bucket body, the spinning device having a spinning element and a pair of barrier blocks, and the spinning element being spun around a longitudinal axis of the spinning element to spin on the bucket body, each barrier block being annularly disposed on an upper surface of the spinning element, the pair of barrier blocks being spaced apart from each other, the pair of barrier blocks protruding from the upper surface of the spinning element, each barrier block being spaced apart from each other by a pair of receiving recesses, wherein the pair of receiving recesses are provided to receive the folded foldable flat mop in such a manner that the pair of receiving recesses accommodates and holds the foldable flat mop, which is folded upwardly and whose two wing boards both protrude out of the pair of receiving recesses as a cleaning element installed under each wing board faces outwardly and exposes outside the spinning device such that the spinning element of the spinning device spins on the bucket body as driven by a spinning force of the foldable flat mop which is folded upwardly and is spinning.

2. The spin type mop cleaning bucket as claimed in claim 1, further comprising an annular rim element, the annular rim element being provided at an upper edge of the bucket body, the annular rim element having a through hole such that the foldable flat mop is folded from an unfolded state while passing through the through hole of the annular rim element from outside of the bucket body.

3. The spin type mop cleaning bucket as claimed in claim 1, wherein the spinning device is provided with a receiving base, the receiving base is provided to support the folded foldable flat mop, the receiving base has a sleeve hole through which the pair of barrier blocks sleeve in such a manner that the receiving base is moved relative to the pair of barrier blocks with multiple halt positions.

4. The spin type mop cleaning bucket as claimed in claim 3, wherein the side surface of the receiving base is provided with a position shifting groove, an inner side surface of each barrier block is provided with a positioning groove, a roller is kept within the position shifting groove and the positioning groove in such a manner that the receiving base and the barrier block are in longitudinal movement in relation to the position shifting groove, the positioning groove has a plurality of sequential extending groove portions including, in sequence, a longitudinal groove portion, a guiding groove portion, a parking groove portion and a restoring groove portion, in which the restoring groove portion extends back to the longitudinal groove portion, wherein the roller moves within the position shifting groove and the positioning groove in such a manner that the receiving base moves in a longitudinal direction in relation to the positioning groove and halts in a first halt position and a second halt position, (1) the first halt position: the foldable flat mop pushes the receiving base to move downward, the downward movement of the receiving base allows the roller to move downward through the longitudinal groove portion to a bottom side of the longitudinal groove portion until the receiving base arrives at a bottom of the spinning device such that the receiving base is in the first halt position, (2) the second halt position: the foldable flat mop pulls the receiving base, from the first halt position, to move upward, the upward movement of the receiving base allows the roller to move upward from the bottom side of the longitudinal groove portion and the guiding groove portion until the roller stays in the parking groove portion such that the receiving base is in the second halt position when the roller stays in the parking groove portion, and (3) from the second halt position back to the first halt position: during the receiving base is in the second halt position, when the foldable flat mop pushes the receiving base to move downward, the downward movement of the receiving base allows the roller to move through the restoring groove portion, move downward through the longitudinal groove portion and move to the bottom side of the longitudinal groove portion until the receiving base arrives at a bottom of the spinning device such that the receiving base is back to the first halt position.

5. The spin type mop cleaning bucket as claimed in claim 1, wherein a plurality of the spinning devices are provided, the plurality of the spinning devices are mounted on the bottom portion of the bucket body, the height of the plurality of the spinning devices are different from each other.

6. The spin type mop cleaning bucket as claimed in claim 5, wherein a partition element is provided between the plurality of spinning devices.

* * * * *